US010883751B2

(12) United States Patent
Saito et al.

(10) Patent No.: US 10,883,751 B2
(45) Date of Patent: Jan. 5, 2021

(54) ICE MAKING MACHINE

(71) Applicants: NIDEC SANKYO CORPORATION, Suwa-gun Nagano (JP); WHIRLPOOL CORPORATION, Benton Harbor, MI (US)

(72) Inventors: Shunji Saito, Suwa-gun Nagano (JP); David Vega, Nuevo Leon (MX)

(73) Assignees: NIDEC SANKYO CORPORATION, Suwa-gun Nagano (JP); WHIRI POOI CORPORATION, Benton Harbor, MI (US)

( * ) Notice: Subject to any disclaimer, the term of this patent is extended or adjusted under 35 U.S.C. 154(b) by 167 days.

(21) Appl. No.: 16/145,810

(22) Filed: Sep. 28, 2018

(65) Prior Publication Data

US 2019/0093937 A1 Mar. 28, 2019

Related U.S. Application Data

(60) Provisional application No. 62/564,756, filed on Sep. 28, 2017.

(51) Int. Cl.

| | |
|---|---|
| ***F25C 1/00*** | (2006.01) |
| ***F25D 17/04*** | (2006.01) |
| ***F25C 5/187*** | (2018.01) |
| ***F25D 17/06*** | (2006.01) |

(Continued)

(52) U.S. Cl.

CPC ..... *F25C 5/187* (2013.01); *F25C 1/04* (2013.01); *F25C 1/10* (2013.01); *F25C 1/243* (2013.01);

(Continued)

(58) Field of Classification Search

CPC ..... F25C 1/00; F25C 1/04; F25C 1/06; F25C 1/10; F25D 17/04; F25D 17/08;

(Continued)

(56) References Cited

U.S. PATENT DOCUMENTS 5,881,558 A 3/1999 Kawahara et al.
6,732,537 B1 * 5/2004 Anell ..... F25C 1/04 62/353

(Continued)

FOREIGN PATENT DOCUMENTS

JP H08261627 A 10/1996
JP 2004271047 A 9/2004

OTHER PUBLICATIONS

USPTO Non-Final Office Action for corresponding U.S. Appl. No. 16/145,784; dated Jun. 1, 2020.

(Continued)

*Primary Examiner* — Frantz F Jules
*Assistant Examiner* — Erik Mendoza-Wilkenfel
(74) *Attorney, Agent, or Firm* — Cantor Colburn LLP

(57) ABSTRACT

An ice making machine may include an ice tray having a plurality of recessed parts and a cold air duct having a cold air inflow port connected with a cold air supply port and one cold air outlet port facing the ice tray on an upper side. A size of the cold air outlet port is smaller than a size of an ice making face of the ice tray having a contour which includes the plurality of the ice making recessed parts along edges of openings of the plurality of the ice making recessed parts, and the cold air outlet port faces a center portion of the ice making face. It is preferable that an opening area of the cold air outlet port is 50% or less of an area of the ice making face and/or is smaller than an opening area of the cold air inflow port.

17 Claims, 13 Drawing Sheets

(51) Int. Cl.

| | |
|---|---|
| ***F25C 1/10*** | (2006.01) |
| ***F25C 1/243*** | (2018.01) |
| ***F25C 5/20*** | (2018.01) |
| ***F25D 29/00*** | (2006.01) |
| ***F25C 1/04*** | (2018.01) |

(52) U.S. Cl.
CPC ..... *F25C 5/22* (2018.01); *F25D 17/062* (2013.01); *F25D 17/065* (2013.01); *F25D 17/067* (2013.01); *F25D 29/005* (2013.01); *F25B 2600/112* (2013.01); *F25C 2305/022* (2013.01); *F25C 2400/10* (2013.01); *F25C 2500/02* (2013.01); *F25D 2317/061* (2013.01); *F25D 2317/0672* (2013.01)

(58) Field of Classification Search
CPC ..... F25D 2317/063; F25D 2317/067; F25D 2317/066; F25D 2317/0665
See application file for complete search history.

(56) References Cited

U.S. PATENT DOCUMENTS

| | | | | |
|---|---|---|---|---|
| 1,762,092 | A1 | 7/2010 | Tikhonov | |
| 2011/0146312 | A1* | 6/2011 | Hong ..... | F25C 5/182 62/137 |
| 2016/0258664 | A1 | 9/2016 | Visin et al. | |
| 2017/0307270 | A1 | 10/2017 | Kim | |
| 2018/0224184 | A1 | 8/2018 | Mitchell | |
| 2019/0086134 | A1 | 3/2019 | Lee et al. | |

OTHER PUBLICATIONS

USPTO Non-Final Office Action for corresponding U.S. Appl. No. 16/145,765; dated Jun. 1, 2020.

* cited by examiner

ICE MAKING MACHINE

CROSS REFERENCE TO RELATED APPLICATION

The present application claims priority under 35 U.S.C. § 119(e) to U.S. provisional application 62/564,756 filed Sep. 28, 2017 the entire content of which is also incorporated herein by reference.

FIELD OF THE INVENTION

At least an embodiment of the present invention may relate to an ice making machine structured to blow cold air to an ice tray to make ice.

BACKGROUND

A freezer or a refrigerator having a refrigerating chamber and a freezing chamber is sometimes mounted with an automatic ice making machine in which ice is made and the ice is supplied to an ice storage container provided in an inside of the freezer or the refrigerator. The ice making machine is disposed in an ice making chamber provided in a freezer or a refrigerator. A cold air supply port is provided in the ice making chamber and cold air is supplied to the ice making chamber through the cold air supply port. An ice making machine includes an ice tray provided with a plurality of ice making recessed parts and a water supply mechanism structured to supply water to the ice tray for storing the water in the ice making recessed parts. The water stored in the ice making recessed parts is frozen by cold air supplied through the cold air supply port to become ice pieces.

An ice making machine described in Japanese Patent Laid-Open No. Hei 8-261627 includes a cold air duct for guiding cold air supplied through the cold air supply port to the vicinity of the ice tray. The cold air duct is provided with a cold air inflow port which is connected with the cold air supply port and a plurality of cold air outlet ports provided in a duct portion which faces the ice tray on an upper side with respect to the ice tray. Each of the plurality of the cold air outlet ports is provided at a position facing each of the ice making recessed parts on an upper side with respect to the ice tray.

In the above-mentioned Patent Literature, in order to make each of the plurality of the cold air outlet ports face each of the ice making recessed parts, the duct portion of the cold air duct provided with the cold air outlet ports is set to have a size covering the entire ice tray from an upper side. However, when the duct portion located on an upper side with respect to the ice tray becomes large, the ice making machine provided with the cold air duct may be difficult to be disposed in a refrigerator.

SUMMARY

In view of the problem described above, at least an embodiment of the present invention may advantageously provide an ice making machine comprising a cold air duct whose duct portion located on an upper side with respect to an ice tray is small.

According to at least an embodiment of the present invention, there may be provided an ice making machine which is disposed in an ice making chamber provided with a cold air supply port to which cold air is supplied. The ice making machine includes an ice tray provided with a plurality of ice making recessed parts, and a cold air duct having a cold air inflow port connected with the cold air supply port and one cold air outlet port which faces the ice tray on an upper side with respect to the ice tray. A size of the cold air outlet port is smaller than a size of an ice making face of the ice tray having a contour which includes the plurality of the ice making recessed parts along edges of openings of the plurality of the ice making recessed parts, and the cold air outlet port faces a center portion of the ice making face.

According to at least an embodiment of the present invention, one cold air outlet port is provided in the cold air duct and a size of the cold air outlet port is smaller than a size of the ice making face of the ice tray. Therefore, a size of a duct portion of the cold air duct in which a cold air outlet port is formed is not required to increase so as to be capable of covering the entire ice tray from an upper side. Accordingly, a size of the cold air duct can be reduced. As a result, an ice making machine comprising the cold air duct can be structured to be compact. Further, the cold air outlet port of the cold air duct faces a center portion of the ice making face and thus, when water stored in the respective ice making recessed parts is to be frozen for obtaining ice pieces, cold air can be flowed along the ice making face of the ice tray and an ice making time for freezing the water can be shortened.

In at least an embodiment of the present invention, an opening area of the cold air outlet port is 50% or less of an area of the ice making face. According to this structure, a size of a duct portion of the cold air duct in which the cold air outlet port is formed can be easily reduced.

In at least an embodiment of the present invention, an inner wall face of a downstream end portion of the cold air duct is provided with a first guide face structured to guide cold air flowing out from the cold air outlet port toward the ice tray in a direction perpendicular to the ice making face. According to this structure, cold air can be rectified by the first guide face and thus an amount of cold air which is flowed out from the cold air outlet port can be increased and the cold air is blown to the ice tray.

In at least an embodiment of the present invention, the first guide face is extended in an upper and lower direction, the cold air duct is provided with a second guide face structured to guide the cold air to the first guide face at a position adjacent to the first guide face on an upstream side in a flowing direction of the cold air, and the second guide face is curved to a lower side from the upstream side toward a downstream side in the flowing direction of the cold air and is continuously connected with an upper end edge of the first guide face. According to this structure, cold air flowed toward the first guide face can be rectified by the second guide face and thus an amount of cold air which is flowed out from the cold air outlet port can be increased and the cold air is blown to the ice tray.

In at least an embodiment of the present invention, the opening area of the cold air outlet port is smaller than an opening area of the cold air inflow port. According to this structure, a flowing speed of the cold air which is flowed out from the cold air outlet port can be increased higher than a flowing speed of the cold air supplied into the cold air supply port. When a flowing speed of the cold air which is blown to the ice tray is increased, the cold air can be efficiently flowed along the ice making face of the ice tray at the time of ice making. Therefore, water stored in the respective ice making recessed parts can be further earlier frozen to make ice pieces.

In at least an embodiment of the present invention, an opening area of the cold air outlet port is 4% or more of an area of the ice making face. When the cold air outlet port is provided with the opening area, the cold air blown from the cold air outlet port can be easily flowed along the ice making face of the ice tray at the time of ice making.

In at least an embodiment of the present invention, the opening area of the cold air outlet port is smaller than an opening area of each of the ice making recessed parts. According to this structure, a size of the cold air duct can be reduced.

In at least an embodiment of the present invention, an ice making machine further includes a drive unit which is provided at an end on one side in a longitudinal direction of the ice tray and is structured to turn the ice tray, and a frame body which supports the ice tray and the drive unit. The ice tray is located on an inner side of the frame body, and the cold air duct is provided with an intermediate duct portion provided in a frame body portion of the frame body which is extended in the longitudinal direction, an upstream side duct portion which is provided with the cold air inflow port and is communicated with the intermediate duct portion, and a downstream side duct portion which is provided with the cold air outlet port and is communicated with the intermediate duct portion. The downstream side duct portion is extended to an upper side with respect to the frame body from a middle position in the longitudinal direction of the frame body portion. According to this structure, a part (intermediate duct portion) of the cold air duct can be provided in the frame body which supports the ice tray and the drive unit and thus the ice tray provided with the cold air duct can be made compact.

In at least an embodiment of the present invention, the intermediate duct portion is extended from an end face on the other side in the longitudinal direction of the frame body to the middle position, the upstream side duct portion is communicated with an upstream end of the intermediate duct portion which is opened at the end face on the other side, and a bottom face of the intermediate duct portion is inclined to an upper side toward the middle position from the end face on the other side. According to this structure, flow passage resistance to cold air in the intermediate duct portion can be restrained.

In at least an embodiment of the present invention, an ice making machine further includes a first duct member which is placed on an upper side of the frame body, and the frame body is provided with a protruded part which is protruded to an inner side at the middle position of the frame body portion. The protruded part is provided with a recessed part on its upper face, and the frame body portion is provided with a groove part on its upper face which is extended from the end face on the other side in the longitudinal direction of the frame body toward the one side to the middle position and an opening part structured to communicate the groove part with the recessed part at the middle position. The first duct member is provided with a duct forming part which is placed on a portion at the middle position of the frame body portion and the protruded part from an upper side and covers one end portion in the longitudinal direction of the groove part and the recessed part, and a cover plate part which is extended to the other side in the longitudinal direction from the duct forming part and covers a portion of the groove part which is not covered by the duct forming part from an upper side. The intermediate duct portion is structured of an inner wall face of the groove part, an inner wall face of the recessed part, and an under face of the cover plate part of the first duct member, and the downstream side duct portion is structured between the duct forming part and the frame body. According to this structure, the intermediate duct portion is provided in the frame body by utilizing the groove part provided in the frame body. Therefore, the intermediate duct portion is easily provided in the frame body. Further, the intermediate duct portion and the downstream side duct portion can be structured by placing the first duct member on the frame body from an upper side. Therefore, an ice making machine including the cold air duct is easily assembled.

In at least an embodiment of the present invention, an opposed face of the protruded part facing the ice tray is a concave curved face and the opposed face is curved to an upper side as going to a center of the ice tray in a short-side direction of the ice tray. According to this structure, when the ice tray is turned by the drive unit on an inner side of the frame body, the protruded part and the ice tray are prevented from interfering with each other. Further, since an interference between the protruded part and the ice tray is avoided, the cold air outlet port of the downstream side duct portion structured between the duct forming part of the first duct member placed on the upper side of the protruded part and the frame body can be disposed at a position in the vicinity of the ice tray.

In at least an embodiment of the present invention, the ice making machine further includes a second duct member which is provided with the upstream side duct portion and is attached to the frame body. According to this structure, the upstream side duct portion is easily communicated with an upstream side of the intermediate duct portion provided in the frame body. Further, in a case that the second duct member which is separately provided from the frame body is provided with the upstream side duct portion, even when a size and a position of the cold air supply port are changed, cold air can be guided to the ice tray from the cold air supply port by changing the second duct member without changing other components.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

An ice making machine 1 in accordance with at least an embodiment of the present invention will be described below with reference to the accompanying drawings. In the present specification, three axes of "X", "Y" and "Z" are directions perpendicular to each other. One side in the "X"-axis direction is indicated as "+X", the other side is indicated as "−X", one side in the "Y"-axis direction is indicated as "+Y", the other side is indicated as "−Y", one side in the "Z"-axis direction is indicated as "+Z", and the other side is indicated as "−Z". The "−Z"-axis direction is a lower side in a vertical direction and the "+Z"-axis direction is an upper side in the vertical direction.

(Ice Making Chamber)

Figure 1:
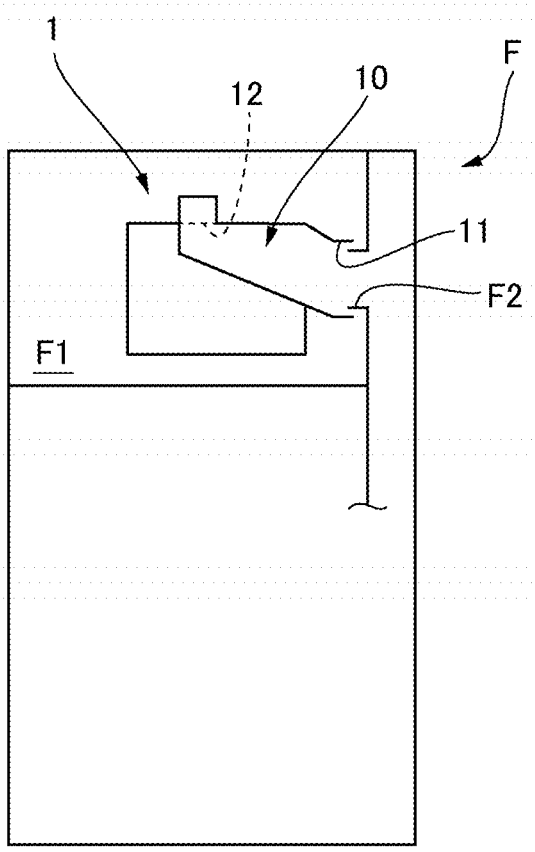
FIG. 1 is an explanatory view schematically showing a refrigerator including an ice making machine in accordance with an embodiment of the present invention.

FIG. 1 is an explanatory view schematically showing a refrigerator "F" which includes an ice making machine 1 to which at least an embodiment of the present invention is applied. An ice making machine 1 is arranged and used in an ice making chamber "F1" of a refrigerator "F". The refrigerator "F" includes a cold air supply part not shown for supplying cold air to the ice making chamber "F1". A cold air supply port "F2" is provided in an inside of the ice making chamber "F1" and the cold air supply port "F2" is connected with the cold air supply part. The ice making machine 1 includes a cold air duct 10 for guiding cold air supplied from the cold air supply port "F2". The cold air duct 10 includes a cold air inflow port 11 which is connected with the cold air supply port "F2" and a cold air outlet port 12.

First Embodiment (Ice Making Machine)

Figure 2:
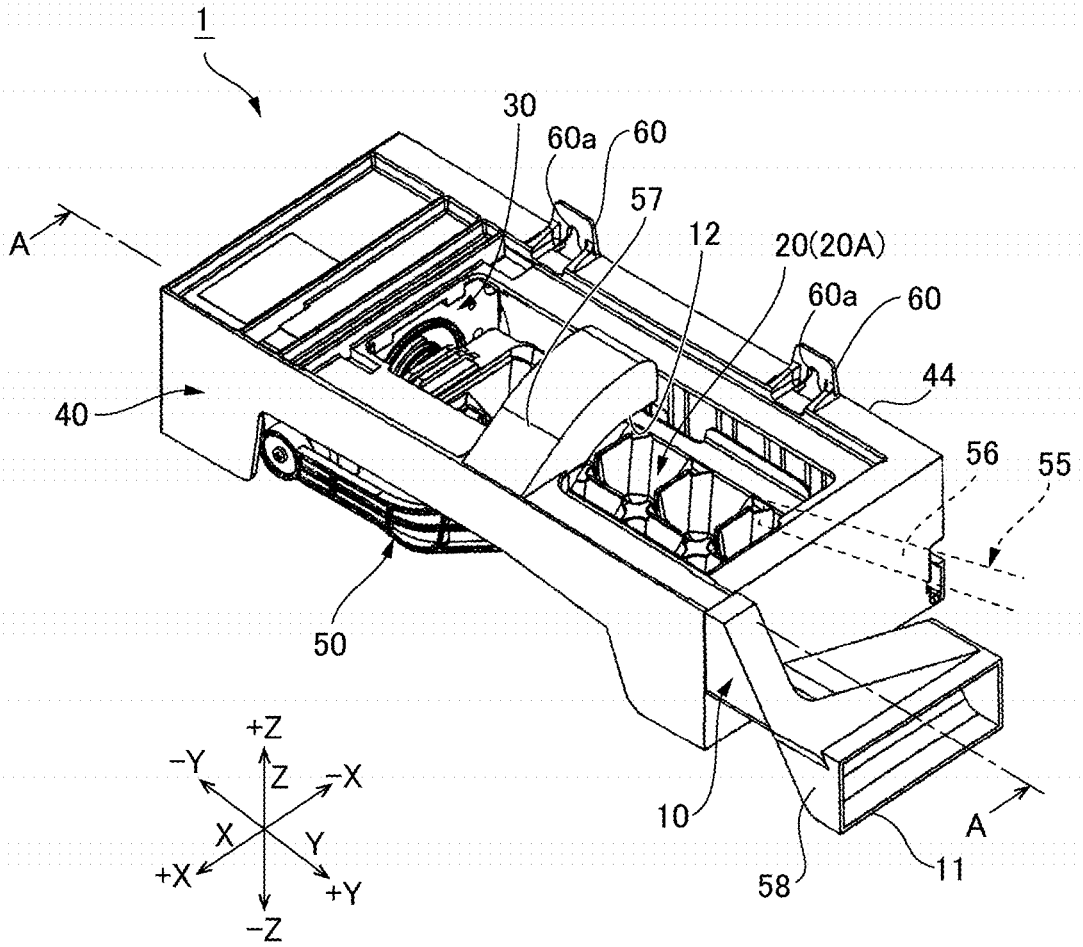
FIG. 2 is a perspective view showing an ice making machine in accordance with a first embodiment of the present invention.
Figure 3:
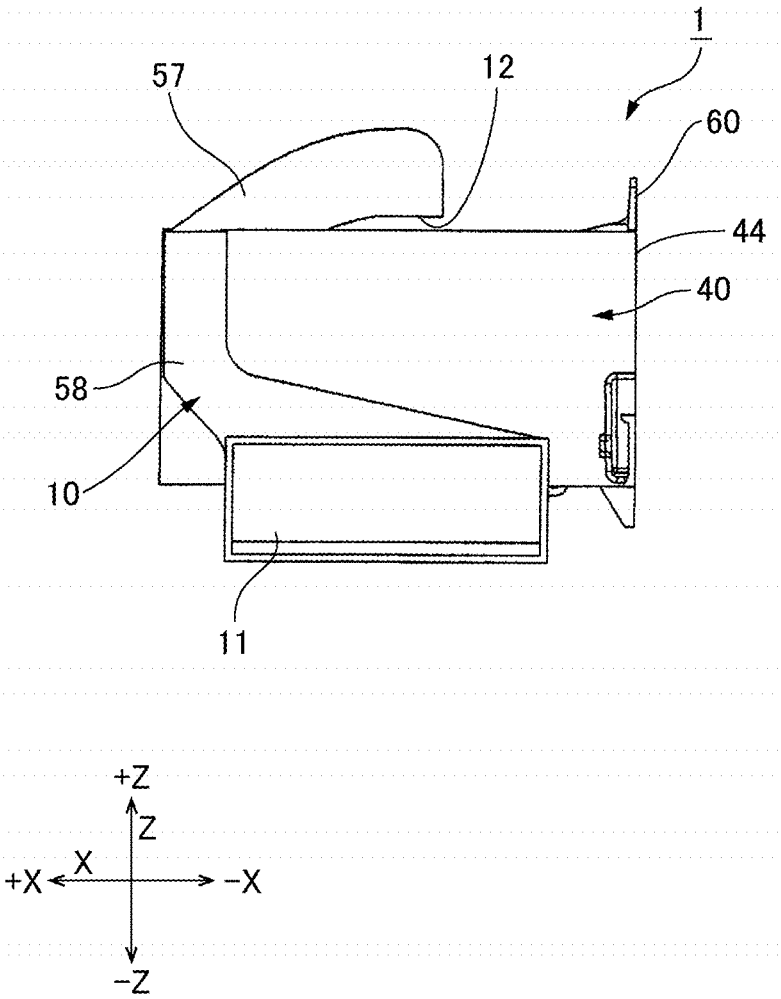
FIG. 3 is a side view showing an ice making machine when viewed from a side of a cold air inflow port of a cold air duct.
Figure 4:
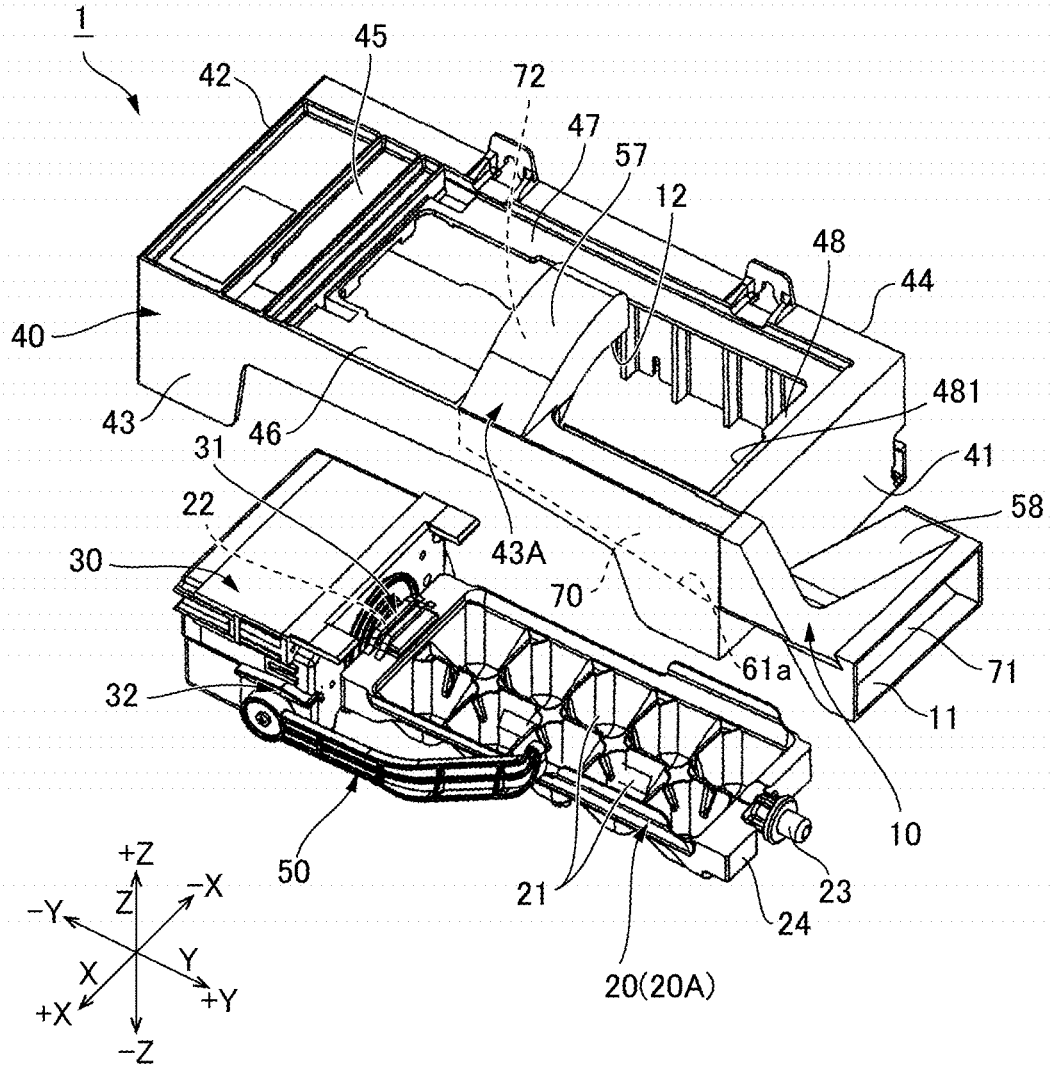
FIG. 4 is an exploded perspective view showing an ice making machine.
Figure 5:
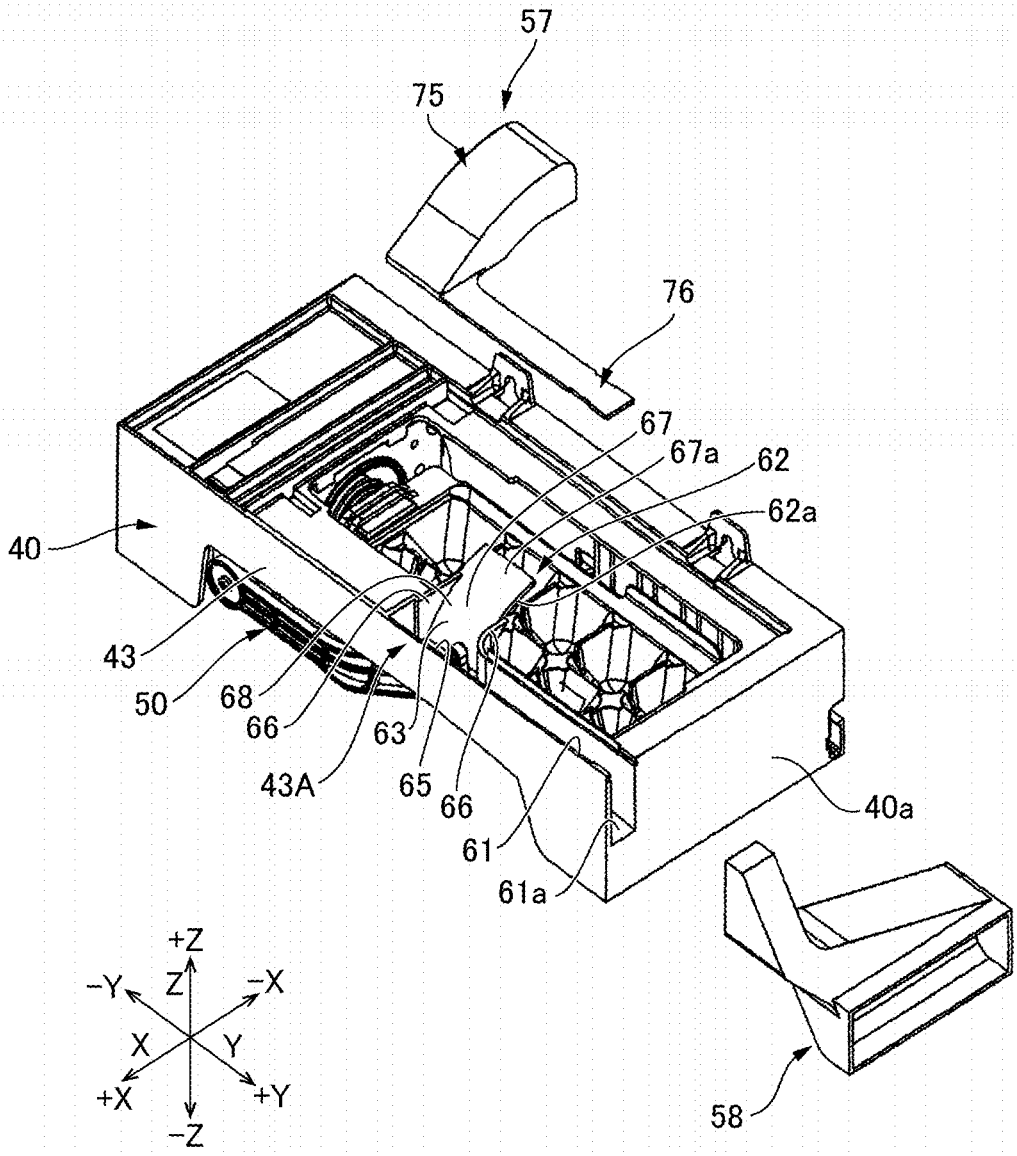
FIG. 5 is another exploded perspective view showing an ice making machine.

FIG. 2 is a perspective view showing an ice making machine 1 to which at least an embodiment of the present invention is applied and FIG. 3 is a side view showing the ice making machine 1 in FIG. 2 when viewed from a side of a cold air inflow port 11 of a cold air duct. FIG. 4 and FIG. 5 are exploded perspective views showing the ice making machine 1. As shown in FIG. 2, the ice making machine 1 includes a cold air duct 10, an ice tray 20, a drive unit 30 for turning the ice tray 20, and a frame body 40 which supports the ice tray 20 and the drive unit 30. Further, the ice making machine 1 includes an ice storage container not shown which is disposed on a lower side ("−Z"-axis direction side) with respect to the ice tray 20 and an ice detection member 50 structured to detect an amount of ice in the ice storage container.

The frame body 40 is provided with attaching parts 60 for fixing the ice making machine 1 to a wall face of the ice making chamber "F1". The attaching parts 60 are protruded to an upper side from a wall part 44 extended in the "Y" direction on a side of the "−X" direction in the frame body 40. Further, the attaching part 60 is provided with a through-hole 60*a* penetrating in the "X" direction. In this embodiment, the ice making machine 1 is fixed to the wall face of the ice making chamber "F1" by a headed screw penetrating through the attaching part 60. In a state that the ice making machine 1 has been fixed to the wall face of the ice making chamber "F1", a head part of the headed screw is abutted with the attaching part 60 from the "+X" direction side. A shaft part of the headed screw is penetrated through the through-hole 60*a* and its tip end portion is screwed to a threaded hole provided in the wall face of the ice making chamber "F1". In this manner, the ice making machine 1 is fixed to the wall face in a state that the wall part 44 is abutted with the wall face of the ice making chamber "F1".

A water supply mechanism 55 for supplying water to the ice tray 20 is disposed on an upper side ("+Z" axial direction side) with respect to the ice making machine 1. The water supply mechanism 55 includes a water supply nozzle 56 for supplying water for ice making to the ice tray 20 from the "+Y" direction side. The water supply nozzle 56 is located on an upper side with respect to the frame body 40.

The ice making machine 1 includes, as shown in FIG. 2 and FIG. 3, a first duct member 57 which is placed on the frame body 40 from an upper side and a second duct member 58 which is fixed to an end portion of the frame body 40 in the "+Y" direction. The cold air duct 10 is structured of a part of the frame body 40, the first duct member 57 and the second duct member 58. The cold air outlet port 12 of the cold air duct 10 faces the ice tray 20 on an upper side with respect to the ice tray 20.

As shown in FIG. 4, the ice tray 20 is formed in a substantially rectangular planar shape and is provided with a plurality of ice making recessed parts 21. As shown in FIG. 2, the ice tray 20 is located on an inner side of the frame body 40. The ice tray 20 is held by the frame body 40 at an ice making position 20A where the ice making recessed parts 21 face an upper side and, in this state, ice making is performed. A longitudinal direction of the ice tray 20 is coincided with the "Y"-axis direction. Further, when the ice tray 20 is located at the ice making position 20A, a short-side direction of the ice tray 20 is coincided with the "X"-axis direction. As shown in FIG. 4, the plurality of the ice making recessed parts 21 is arranged in the longitudinal direction of the ice tray 20 and two rows are provided in its short-side direction. The drive unit 30 is disposed on one side ("−Y" direction) in the longitudinal direction of the ice tray 20. Further, the ice detection member 50 is disposed on the "+X" direction side with respect to the ice tray 20.

As shown in FIG. 4, the drive unit 30 includes a first drive mechanism 31 structured to turn the ice tray 20, a second drive mechanism 32 structured to turn the ice detection member 50 in an upper and lower direction, and a motor not shown which is a drive source. The motor is a DC motor and is driven by an electric current supplied from the refrigerator "F" on which the ice making machine 1 is mounted. The ice tray 20 is provided with turning shafts 22 and 23 which are protruded from its one end and the other end in the longitudinal direction. The turning shaft 22 protruded to the drive unit 30 side ("−Y" direction side) is connected with an output shaft of the first drive mechanism 31 so as to be turned together. The turning shaft 23 protruded to an opposite side to the drive unit 30 is turnably supported by the frame body 40.

The drive unit 30 transmits rotation of the motor to the ice tray 20 through the first drive mechanism 31 to turn the ice tray 20. When the ice tray 20 is turned by a predetermined angle (for example, 120 degrees) from the ice making position 20A, a projection 24 formed at an end part in the longitudinal direction of the ice tray 20 is abutted with an abutting part 411 (see FIG. 6) formed in the frame body 40. When the ice tray 20 is further turned, a force in a twisting direction is applied to the ice tray 20. As a result, the ice tray 20 is twisted and deformed and ice pieces in the ice making recessed parts 21 are separated and dropped to an ice storage container. After the drive unit 30 turns the ice tray 20 by a predetermined angle (for example, 160 degrees) to separate ice pieces, the drive unit 30 turns the ice tray 20 in a reverse direction and the ice tray 20 is returned to the ice making position 20A.

(Frame Body)

Figure 6:
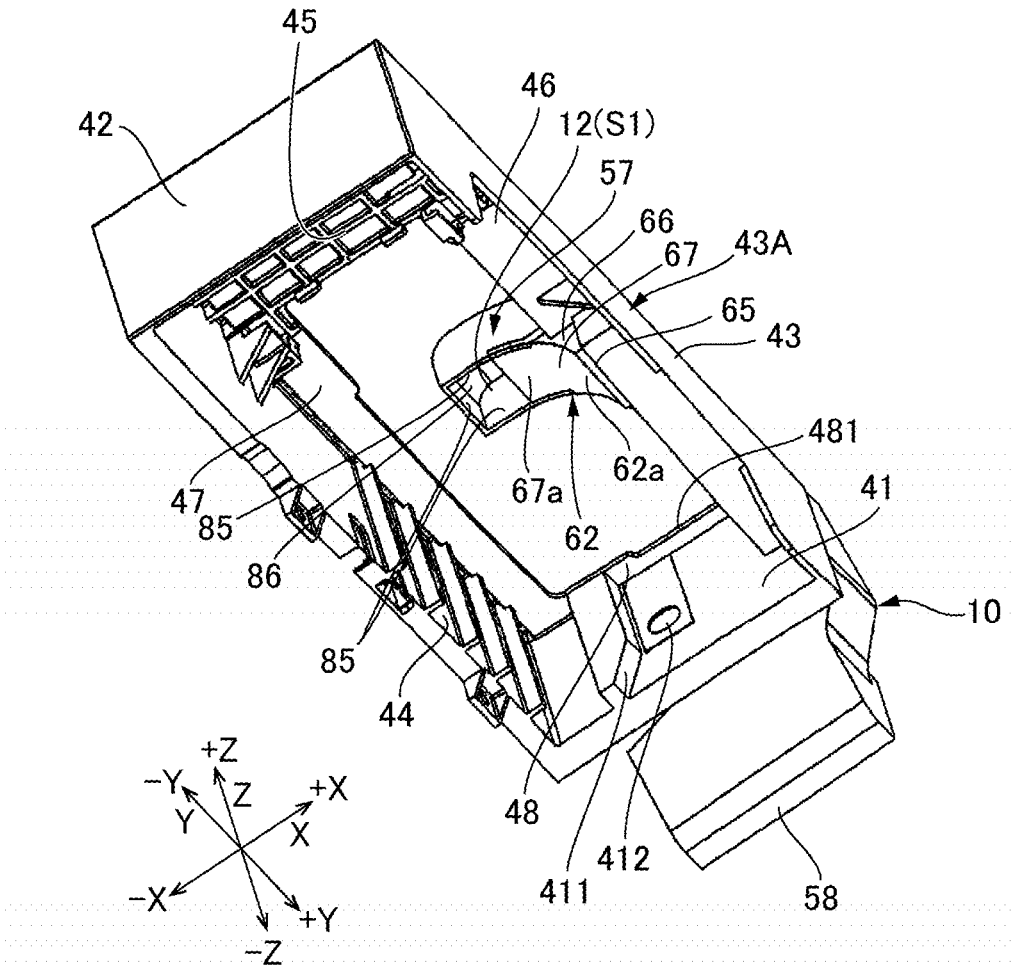
FIG. 6 is a perspective view showing a frame body.

FIG. 6 is a perspective view showing the frame body 40 and the cold air duct 10 which are viewed from an obliquely lower side in the "−Y" direction. The frame body 40 has a substantially rectangular planar shape and surrounds an outer peripheral side of the ice tray 20 and the drive unit 30. As shown in FIG. 4 and FIG. 6, the frame body 40 is provided with a wall part 41 located on the "+Y" direction side of the ice tray 20, a wall part 42 located on the "−Y" direction side of the drive unit 30, a wall part 43 located on the "+X" direction side of the ice tray 20 and the drive unit 30, and a wall part 44 located on the "−X" direction side of the ice tray 20 and the drive unit 30. The wall part 41 and the wall part 42 are extended in the "X"-axis direction, and the wall part 43 and the wall part 44 are extended in the "Y"-axis direction (longitudinal direction of the ice tray 20).

As shown in FIG. 6, the wall part 41 located on the "+Y" direction side is formed with a holding hole 412 which turnably holds the turning shaft 23. Further, an inner face of the wall part 41 is provided with the abutting part 411 which is structured to abut with the projection 24 of the ice tray 20 and restrict its turning. The drive unit 30 is fixed to an inner face of the wall part 42 located on the "−Y" direction side. Therefore, the wall part 41 located on the "+Y" direction side faces the drive unit 30. The ice tray 20 is disposed between the drive unit 30 and the wall part 41.

The frame body 40 is provided with an upper plate part 45 which covers an upper part of the drive unit 30, an inner frame part 46 which is projected to an inner side from an end side portion in the "−Y" direction of the wall part 43 so as to be continuously connected with the upper plate part 45, an inner frame part 47 which is projected to an inner side from the wall part 44 on the "−X" direction side, and an inner frame part 48 which is projected to an inner side from the wall part 41 on the "+Y" direction side. The inner frame part 47 and the inner frame part 48 are formed continuously. The inner frame parts 46, 47 and 48 are formed in thin plate shapes and are provided at a position recessed on the "−Z" axial direction side with respect to upper ends of the wall part 43, the wall part 44 and the wall part 41. An end side portion in the "+X" direction of the inner frame part 48 is formed with a cut-out part 481 at its inner peripheral edge. The cut-out part 481 is provided for avoiding an interference between the ice tray 20, which is applied with a force in the twisting direction and is deformed, and the inner frame part 48.

As shown in FIG. 5, an upper face of the wall part 43 in the "+X" direction of the frame body 40 is provided with a groove part 61 which is extended from an end face in the "+Y" direction of the frame body 40 toward the "−Y" direction to a middle position 43A in the "Y"-axis direction. The groove part 61 is provided as a cold air passage on an inner side of an outer wall face of the wall part 43, and an upper face of the wall part 43 and the end face 40*a* in the "+Y" direction of the frame body 40 are opened. The middle position 43A is a position of the wall part 43 which faces in the "X"-axis direction a center portion in the "Y"-axis direction of the ice tray 20 (a center portion in the longitudinal direction of the ice tray 20), and cold air is sent from this position to the center portion of the ice tray 20. The wall part 43 has a certain width in the upper and lower direction and thus, a bottom face 61*a* of the groove part 61 can be, as shown by the dotted line in FIG. 4, structured to incline to an upper side as going toward the middle position 43A from the end face 40*a* in the "+Y" direction of the frame body 40. Therefore, flow passage resistance can be restrained.

Further, the wall part 43 is, as shown in FIG. 5, provided with a protruded part 62 which is protruded from the bottom face 61*a* of the groove part 61 at the middle position 43A in the "Y"-axis direction to an inner side of the frame body 40. An opposed face 62*a* of the protruded part 62 facing the ice tray 20 (face directing to an inner side of the frame body 40) is formed in a concave curved face and the opposed face 62*a* is curved to an upper side as going to the center of the ice tray 20 in the "X"-axis direction.

The protruded part 62 is provided with a recessed part 63 which is communicated with the groove part 61 on its upper face. In other words, the protruded part 62 is provided with a bottom plate part 65 extended from the wall part 43 to an inner side, a pair of side plate parts 66 which are extended to an upper side from both sides in the "Y"-axis direction of the bottom plate part 65 and are continuously connected with the wall part 43, an inner side plate part 67 which connects end parts in the "−X" direction of the pair of the side plate parts 66, and the recessed part 63 which is surrounded by the bottom plate part 65, the pair of the side plate parts 66 and the inner side plate part 67. In this embodiment, the wall part 43 is provided at the middle position 43A with an opening part 68 which connects the groove part 61 with the recessed part 63. In this manner, the groove part 61 is communicated with the recessed part 63 through the opening part 68.

Upper ends (upper faces) of the pair of the side plate parts 66 of the protruded part 62 are set to be the same height position as an upper face of the wall part 43. End edges in the "−X" direction of the pair of the side plate parts 66 are curved in a concave shape toward an upper side as going to the center of the ice tray 20 in the "X"-axis direction. The inner side plate part 67 which connects the end edges in the "−X" direction of the pair of the side plate parts 66 is curved along shapes of the end edges in the "−X" direction of the pair of the side plate parts 66. Therefore, the opposed face 62*a* of the protruded part 62 is formed in a concave curved face. An upper end portion of the inner side plate part 67, in other words, its end portion in the "−X" direction is provided with a protruding plate portion 67*a* which is protruded to an upper side with respect to the wall part 43.

The cold air duct 10 is, as shown in FIG. 4, provided with an intermediate duct portion 70 provided by utilizing the frame body 40, an upstream side duct portion 71 which is provided with the cold air inflow port 11 and is connected with an upstream side of the intermediate duct portion 70, and a downstream side duct portion 72 which is provided with the cold air outlet port 12 and is connected with a downstream side of the intermediate duct portion 70. The intermediate duct portion 70 is structured of the groove part 61 provided in the wall part 43 of the frame body 40, the recessed part 63 of the protruded part 62 which is protruded to an inner side from the wall part 43, and a part of the first duct member 57 which is placed on the frame body 40. The downstream side duct portion 72 is extended from the middle position 43A of the wall part 43 to an upper side with respect to the frame body 40, in other words, toward a side of the ice tray 20. The downstream side duct portion 72 is structured between the first duct member 57 which is placed on the frame body 40 and the frame body 40. The upstream side duct portion 71 is provided in an inside of the second duct member 58 which is fixed to the frame body 40.

Figure 7A:
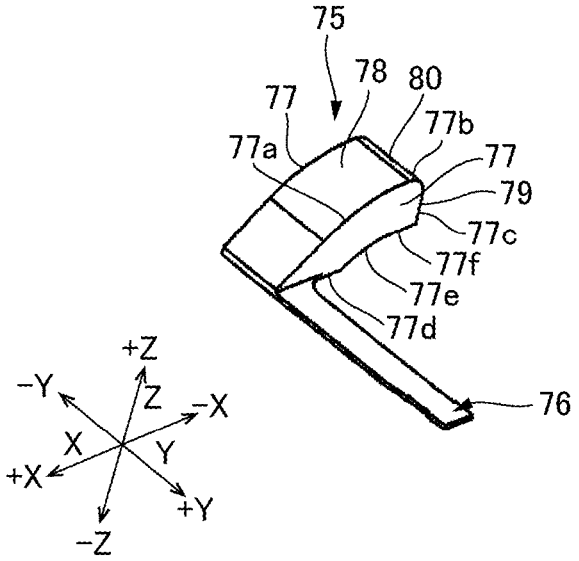
FIG. 7A and FIG. 7B are perspective views showing a first duct member.
Figure 7B:
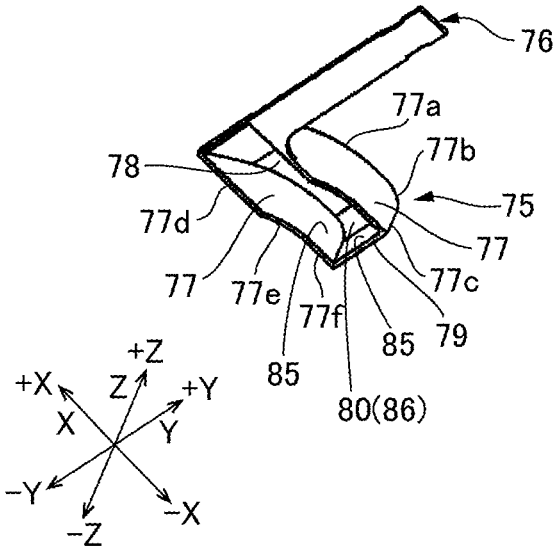
Figure 8:
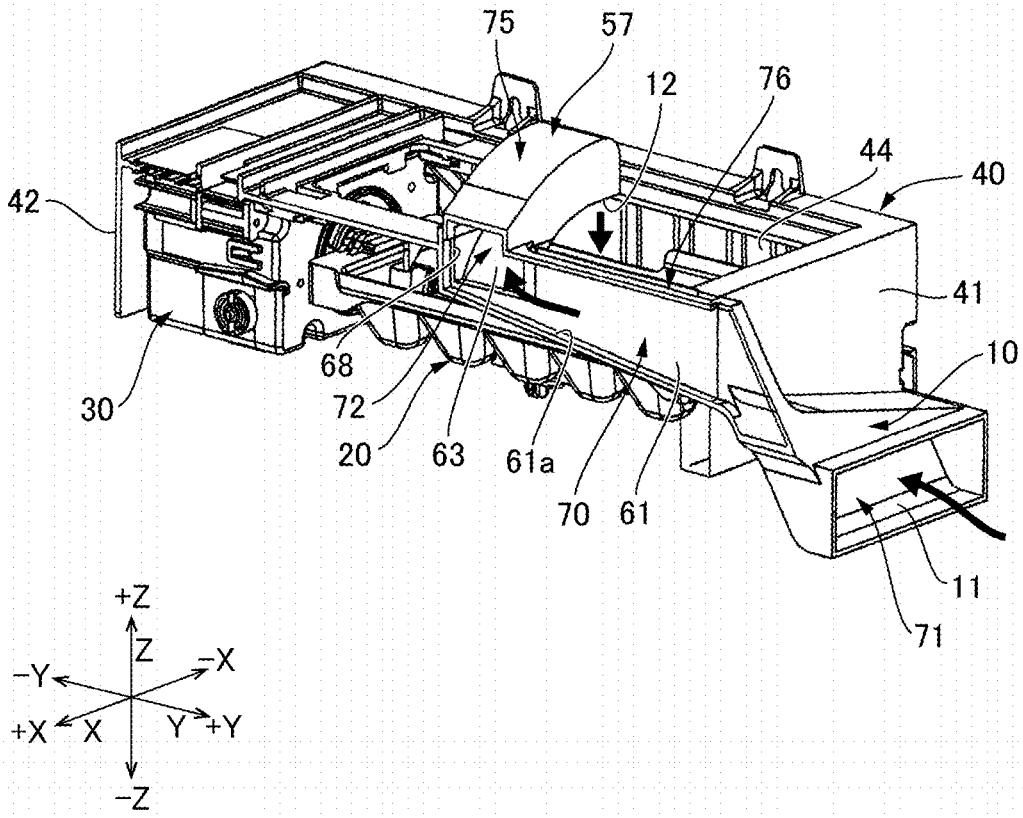
FIG. 8 is a cross-sectional perspective view showing the ice making machine which is cut by the "A-A" line in FIG. 2.

FIG. 7A and FIG. 7B are perspective views showing the first duct member 57. FIG. 8 is a cross-sectional perspective view showing the ice making machine 1 which is cut by the "A-A" line in FIG. 2. The first duct member 57 is provided with a duct forming part 75 which is placed and overlapped on the middle position 43A of the wall part 43 and the protruded part 62 from an upper side to cover an end portion in the "−Y" direction of the groove part 61 and the recessed part 63 from an upper side, and a cover plate part 76 which is extended to the "+Y" direction from the duct forming part 75 and covers an upper end opening of the groove part 61 in the wall part 43. The duct forming part 75 is provided with a pair of side plate portions 77 extended in the "X"-axis direction in parallel to each other, a ceiling plate portion 78 which connects upper end edges of the pair of the side plate portions 77, a vertical plate portion 79 which connects end edges in the "−X" direction of the pair of the side plate portions 77, and a curved plate portion 80 between the ceiling plate portion 78 and the vertical plate portion 79. A pair of the side plate portions 77 is extended along the "Z-X" plane. An upper end edge of each of the side plate portions 77 is provided with a first curved edge portion 77*a* which is curved in a convex shape toward an upper side as going to the "−X" direction in the "X"-axis direction, a second curved edge portion 77*b* which is curved toward a lower side from an end in the "−X" direction of the first curved edge portion 77*a*, and a straight edge portion 77*c* which is extended to a lower side along the "Z-Y" plane from a tip end of the second curved edge portion 77*b*. The ceiling plate portion 78 connects the first curved edge portions 77*a* of the pair of the side plate parts 66, the curved plate portion 80 connects the second curved edge portions 77*b*, and the vertical plate portion 79 connects the straight edge portions 77*c*.

Each of lower end edges of the pair of the side plate portions 77 is provided with a first straight edge portion 77*d* which is extended along the frame body 40 and an upper face of the protruded part 62 toward the "−X" direction in the "X"-axis direction, a curved edge portion 77*e* which is curved in a concave shape toward an upper side from an end in the "−X" direction of the first straight edge portion 77*d*, and a second straight edge portion 77*f* which is extended in a straight line shape from an end in the "−X" direction of the curved edge portion 77*e*. A shape of the curved edge portion 77*e* is a shape corresponding to a curved shape of the protruding plate portion 67*a* of the inner side plate part 67 which structures the protruded part 62 of the frame body 40. The cover plate part 76 is extended in the "Y"-axis direction with a constant width from the first straight edge portion 77*d* for the side plate part 66 which is located on the "+Y" direction side of the pair of the side plate parts 66.

In a state that the first duct member 57 is placed on the frame body 40, as shown in FIG. 4, the duct forming part 75 is overlapped and placed on the middle position 43A of the frame body 40 and the protruding plate portion 67*a* from an upper side, and the first duct member 57 covers an end portion in the "−Y" direction of the groove part 61 and the recessed part 63. Further, the cover plate part 76 covers a portion of the groove part 61 which is not covered by the duct forming part 75 from an upper side. In this embodiment, a space structured of an inner wall face of the groove part 61, an inner wall face of the recessed part 63, and an under face of the cover plate part 76 of the first duct member 57 is the intermediate duct portion 70. Therefore, a portion of the first duct member 57 which covers the middle position 43A and the cover plate part 76 structure the intermediate duct portion 70.

Further, in the state that the first duct member 57 is placed on the frame body 40, as shown in FIG. 4 and FIG. 8, a downstream side duct portion 72 is formed between the duct forming part 75 and the protruding plate portion 67*a* of the frame body 40. In other words, as shown in FIG. 8, the straight edge portions 77*d* of the lower end edges of the pair of the side plate portions 77 are abutted with upper faces of the wall part 43 and the protruded part 62 and, as shown in FIG. 6, the curved edge portions 77*e* of the pair of the side plate portions 77 are abutted with both end edges in the "Y"-axis direction of the protruding plate portion 67*a* of the inner side plate part 67 of the protruded part 62. In this manner, a space structured of the pair of the side plate portions 77, the ceiling plate portion 78, the curved plate portion 80, the vertical plate portion 79 and the protruding plate portion 67*a* of the inner side plate part 67 of the protruded part 62 is structured as the downstream side duct portion 72. In this embodiment, as shown in FIG. 6, a rectangular space formed between an upper end edge (end edge on the inner side) of the protruding plate portion 67*a* of the inner side plate part 67 of the protruded part 62 and the vertical plate portion 79 of the first duct member 57 is the cold air outlet port 12 of the cold air duct 10.

Figure 9A:
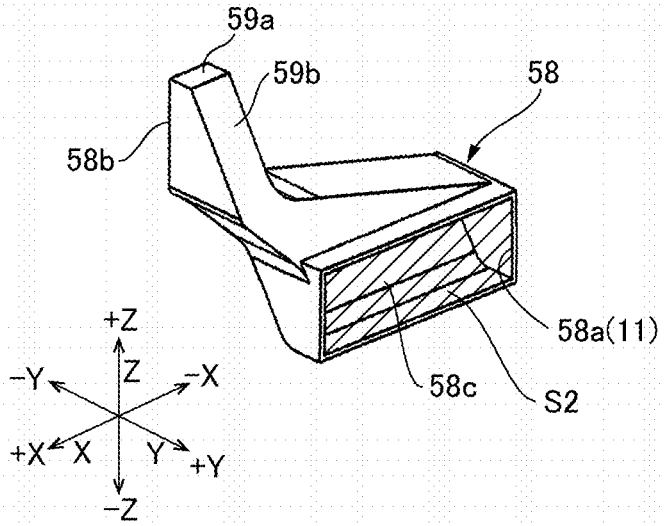
FIG. 9A and FIG. 9B are perspective views showing a second duct member.
Figure 9B:
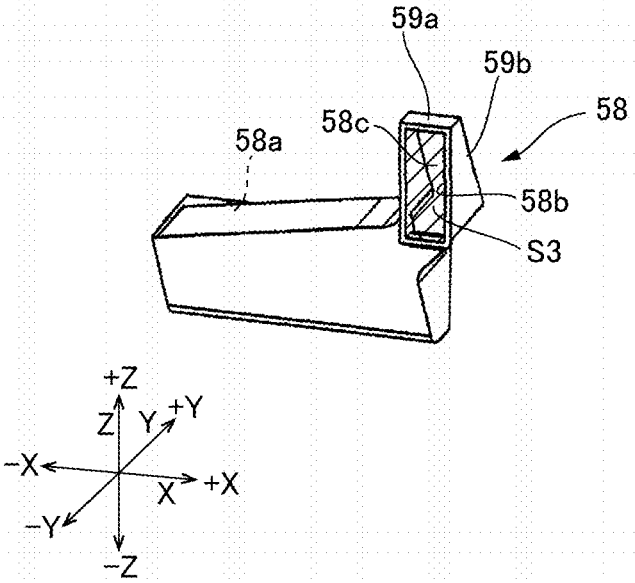

FIG. 9A is a perspective view showing the second duct member 58 when viewed from an obliquely upper side in the "+X" direction, and FIG. 9B is a perspective view showing the second duct member 58 which is viewed from an obliquely upper side in the "−Y" direction. The second duct member 58 is a hollow member. As shown in FIG. 9A, the second duct member 58 is provides with a first opening part 58*a* facing the "+Y" direction at an end portion in the "+Y" direction. The first opening part 58*a* is formed in a rectangular shape into which the cold air supply port "F2" is capable of being inserted on its inner side. A length in the "X"-axis direction of the first opening part 58*a* is longer than that in the "Z"-axis direction. Further, the second duct member 58 is, as shown in FIG. 9B, provided with a second opening part 58*b* which faces the "−Y" direction at an end portion in the "−Y" direction. The second opening part 58*b* is formed in a rectangular shape corresponding to an opening of the groove part 61 which is provided at the end face 40*a* in the "+Y" direction of the frame body 40. A length in the "Z"-axis direction of the second opening part 58*b* is longer than that in the "X"-axis direction. The first opening part 58*a* and the second opening part 58*b* are communicated with each other through a hollow part 58*c* of the second duct member 58. In this embodiment, as shown in FIG. 4, the hollow part 58*c* of the second duct member 58 is the upstream side duct portion 71, and the first opening part 58*a* is the cold air inflow port 11 of the cold air duct 10.

The second duct member 58 is connected with the frame body 40 in a state that the second opening part 58*b* and the opening of the groove part 61 provided at the end face 40*a* of the frame body 40 are communicated with each other. In this manner, the upstream side duct portion 71, the intermediate duct portion 70 and the downstream side duct portion 72 are connected with each other to structure the cold air duct 10. The first opening part 58*a* (cold air inflow port 11) of the second duct member 58 is connected with the cold air supply port "F2" of a refrigerator. In this embodiment, as shown in FIG. 6, an opening area "S1" of the cold air outlet port 12 of the cold air duct 10 is smaller than an opening area "S2" of the first opening part 58*a* (cold air inflow port 11) of the second duct member 58. Further, an opening area "S3" of the second opening part 58*b* of the second duct member 58 is also smaller than the opening area "S2" of the first opening part 58*a* (cold air inflow port 11). Further, the opening area "S1" of the cold air outlet port 12 is smaller than the opening area "S3" of the second opening part 58*b*.

(Cold Air Outlet Port of Cold Air Duct)

Figure 10:
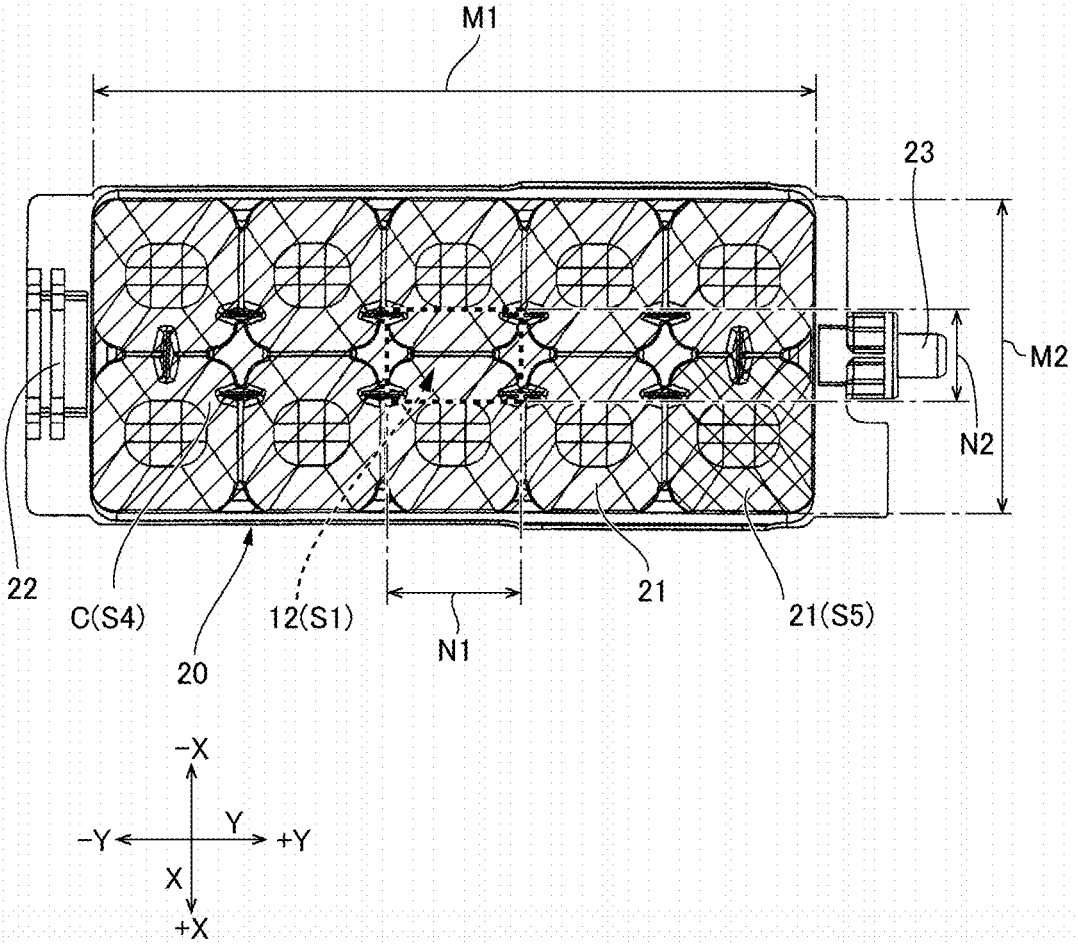
FIG. 10 is an explanatory view showing a positional relationship between an ice making face of an ice tray and a cold air outlet port of a cold air duct.

FIG. 10 is an explanatory view showing a positional relationship between the cold air outlet port 12 of the cold air duct 10 and the ice tray 20 located at the ice making position 20A. As shown in FIG. 10, the cold air outlet port 12 of the cold air duct 10 is formed in a rectangular shape and faces a center of an ice making face "C" of the ice tray 20 (a center in the "Y"-axis direction and a center in the "X"-axis direction of the ice making face "C"). The ice making face "C" of the ice tray 20 is a face having a contour including all of the plurality of the ice making recessed parts 21 along edges of openings of the plurality of the ice making recessed parts 21 of the ice tray 20. In this embodiment, the ice making face "C" is rectangular. The ice making face "C" is a face having a contour of a water surface when a predetermined amount of water for ice making is filled in the ice tray 20 which is located at the ice making position 20A.

The opening area "S1" (N1×N2) of the cold air outlet port 12 of the cold air duct 10 is 4% or more, and not more than 50% of an area "S4" (M1×M2) of the ice making face "C" of the ice tray 20. In addition, in this embodiment, the opening area "S1" of the cold air outlet port 12 is smaller than an opening area "S5" of each of the ice making recessed parts 21.

In this embodiment, the opening area "S1" of the cold air outlet port 12 is not more than 50% of the area "S4" of the ice making face "C" of the ice tray 20 and thus a size of a duct portion (first duct member 57) of the cold air duct 10 where the cold air outlet port 12 is formed is not required to increase so as to be capable of covering the entire ice tray 20 from an upper side. Therefore, a size of the cold air duct 10 can be reduced. Further, the cold air outlet port 12 faces the center of the ice making face "C" and thus, when water stored in the respective ice making recessed parts 21 is to be frozen to make ice pieces, cold air flowed out from the cold air outlet port 12 can be spread along the ice making face "C" of the ice tray 20. Therefore, an ice making time can be shortened. On the other hand, the opening area "S1" of the cold air outlet port 12 is not less than 4% of the area "S4" of the ice making face of the ice tray 20 and thus, cold air flowed out from the cold air outlet port 12 is easily spread along the ice making face of the ice tray 20 at the time of ice making.

Further, in this embodiment, a pair of the side plate portions 77 and the vertical plate portion 79 which determine the cold air outlet port 12 in the first duct member 57 are extended in the "Z"-axis direction. Inner side faces of the pair of the side plate portions 77 and an inner side face of the vertical plate portion 79 which are extended in the "Z"-axis direction function as a first guide face 85 which guides cold air flowed out from the cold air outlet port 12 toward the center portion of the ice tray 20 in a direction perpendicular to the ice making face "C" in a downstream end of the cold air duct 10 (see FIG. 6). Therefore, cold air flowed through the cold air duct 10 is rectified by the first guide face 85 to flow perpendicularly toward the ice making face "C". Accordingly, an amount of cold air flowed out from the cold air outlet port 12 can be increased and cold air is blown to the ice tray 20.

In addition, in this embodiment, an inner side face of the curved plate portion 80 continuously provided on an upper side of the vertical plate portion 79 functions as a second guide face 86 which guides cold air flowed through the cold air duct 10 to the inner side face (first guide face 85) of the vertical plate portion 79 (see FIG. 6). More specifically, the inner side face (second guide face 86) of the curved plate portion 80 is curved to a lower side from an upstream side in a flowing direction of cold air to a downstream side and is continuously connected with an upper end edge of the inner side face (first guide face 85) of the vertical plate portion 79. As a result, the inner side face of the curved plate portion 80 rectifies cold air which is flowed through the cold air duct 10 toward the inner side face (first guide face 85) of the vertical plate portion 79 and thus more cold air flowed out from the cold air outlet port 12 can be perpendicularly blown to the ice tray 20.

Further, in this embodiment, the opening area "S1" of the cold air outlet port 12 is smaller than the opening area "S2" of the cold air inflow port 11. In a case that cold air which is flowed into the cold air inflow port 11 with a predetermined pressure is flowed out from the cold air outlet port 12 whose opening area is smaller than that of the cold air inflow port 11, a flowing-out speed of the cold air from the cold air outlet port 12 is increased. Therefore, a flowing speed of the cold air which is flowed out from the cold air outlet port 12 is increased higher than a flowing speed of the cold air which is supplied into the cold air supply port "F2". In order to perform this operation appropriately, it is effective that the curved plate portion 80 continuously connected with the upper side of the vertical plate portion 79 is provided so that cold air can be flowed smoothly. When a flowing speed of the cold air which is blown to the ice tray 20 is increased, water stored in the respective ice making recessed parts 21 can be further earlier frozen and thus an ice making time period can be shortened. Further, when a flowing speed of cold air is increased, the cold air which is flowed out from the cold air outlet port 12 is easily spread over the entire ice tray 20.

In this embodiment, the intermediate duct portion 70 of the cold air duct 10 is structured in the wall part 43 of the frame body 40 which is formed in parallel to the longitudinal direction of the ice tray 20. Therefore, the ice tray 20 provided with the cold air duct 10 can be made compact. Further, an interference between the cold air duct 10 and the water supply nozzle 56 of the water supply mechanism 55 can avoided.

Further, the bottom face of the intermediate duct portion 70 (bottom face 61*a* of the groove part 61) structured in the frame body 40 is inclined to an upper side toward the middle position 43A of the wall part 43 from the end face 40*a* in the "+Y" direction of the frame body 40. Therefore, a flow passage resistance in the intermediate duct portion 70 can be restrained.

In addition, in this embodiment, the intermediate duct portion 70 is structured by utilizing the groove part 61 provided in the frame body 40. Therefore, the intermediate duct portion 70 can be easily provided in the frame body 40. Further, when the first duct member 57 is placed on the frame body 40 from an upper side, the intermediate duct portion 70 and the downstream side duct portion 72 are structured and thus assembling of the ice making machine 1 including the cold air duct 10 is easily performed.

The protruded part 62 which is protruded from the wall part 43 to an inner side of the frame body 40 and structures a part of the cold air duct 10 is formed so that the opposed face 62*a* facing the ice tray 20 is formed in a concave curved face. Therefore, when the ice tray 20 is turned by the drive unit on an inner side of the frame body 40, the protruded part 62 and the ice tray 20 are prevented from being interfered with each other. In other words, the opposed face 62*a* of the protruded part 62 is formed in a concave curved face at a position so that, when the ice tray 20 is turned by the drive unit on an inner side of the frame body 40, the ice tray 20 is capable of being turned in the vicinity of the opposed face 62*a* but the protruded part 62 and the ice tray 20 are not interfered with each other. Further, since an interference between the protruded part 62 and the ice tray 20 is avoided, the cold air outlet port 12 of the downstream side duct portion 72 structured between the duct forming part 75 of the first duct member 57 placed on an upper side of the protruded part 62 and the frame body 40 can be disposed at a position in the vicinity of the ice tray 20.

In addition, in this embodiment, the hollow part 58*c* of the second duct member 58 is the upstream side duct portion 71 and, when the second duct member 58 is connected with the frame body 40, the intermediate duct portion 70 provided in the frame body 40 and the upstream side duct portion 71 are connected with each other. In this embodiment, the second duct member 58 is separately provided from the frame body 40. Therefore, cold air can be guided to the ice tray 20 from the cold air supply port "F2" by changing the second duct member 58 without changing other components depending on a size and a position of the cold air supply port "F2".

In the embodiment described above, the second duct member 58 is, as shown in FIG. 9A and FIG. 9B, provided with a ceiling plate portion 59*a* which determines an upper end opening edge of the second opening part 58*b* and an inclined plate portion 59*b* which is inclined to the "−Z" direction from the ceiling plate portion 59*a* as going to the "+Y" direction. However, it may be structured that the ceiling plate portion 59*a* and the inclined plate portion 59*b* are formed to be a curved plate portion which is curved to the "−Z" direction as going to the "+Y" direction. According to this structure, the hollow part 58*c* of the second duct member 58 is bent smoothly and thus, flow passage resistance to cold air can be restrained in an inside of the upstream side duct portion 71.

Second Embodiment

Figure 11:
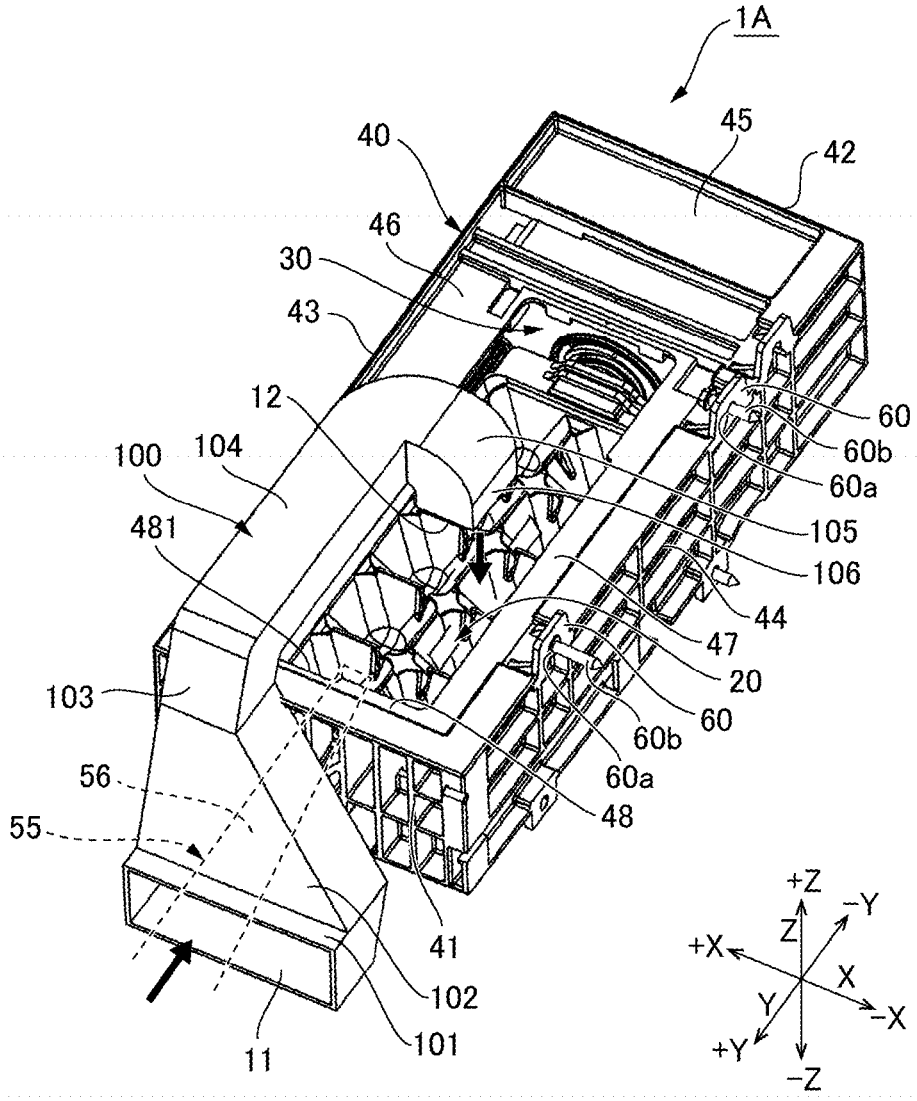
FIG. 11 is a perspective view showing an ice making machine in accordance with a second embodiment of the present invention.
Figure 12A:
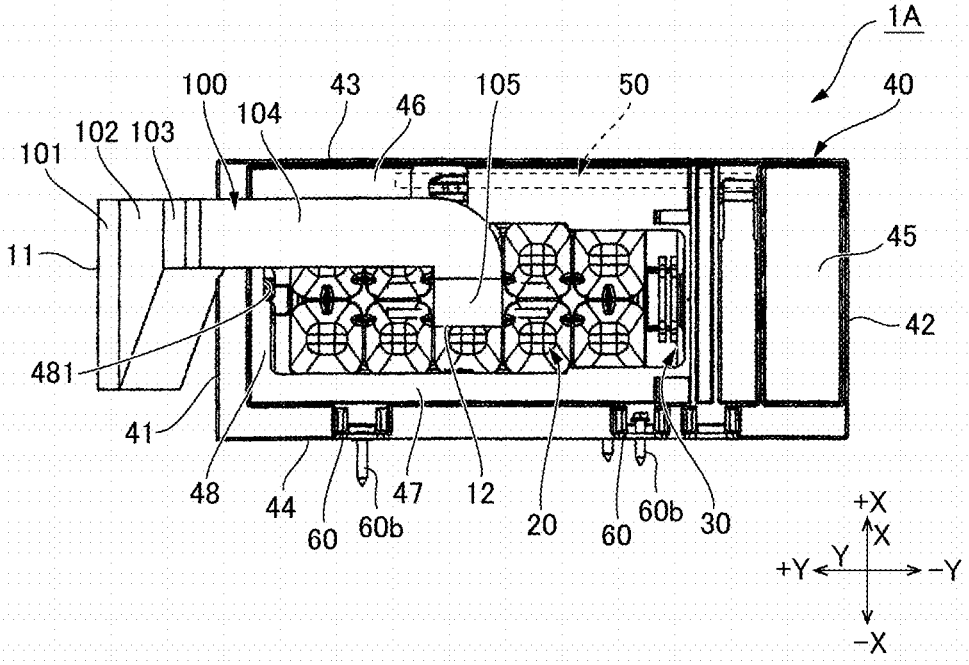
FIG. 12A and FIG. 12B are a plan view and a side view showing the ice making machine in FIG. 11.
Figure 12B:
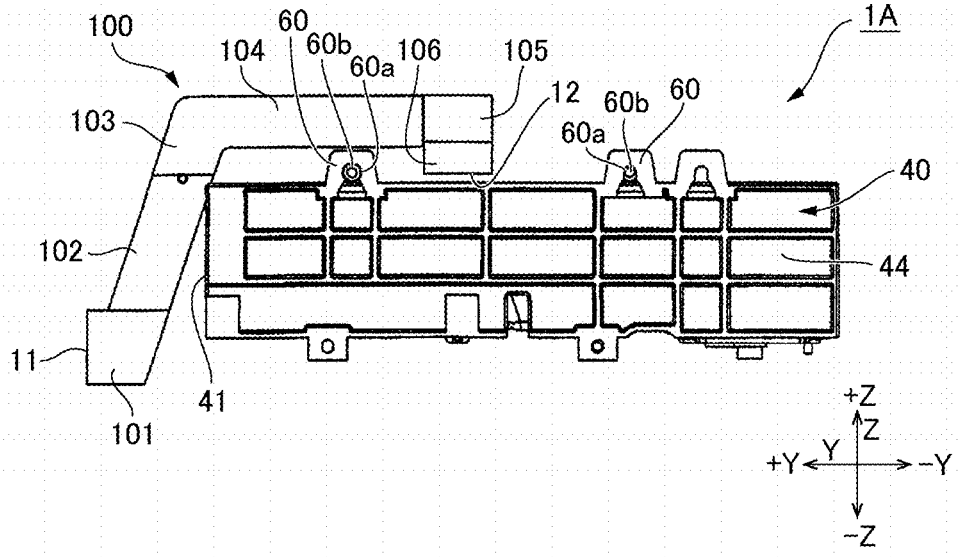
Figure 13A:
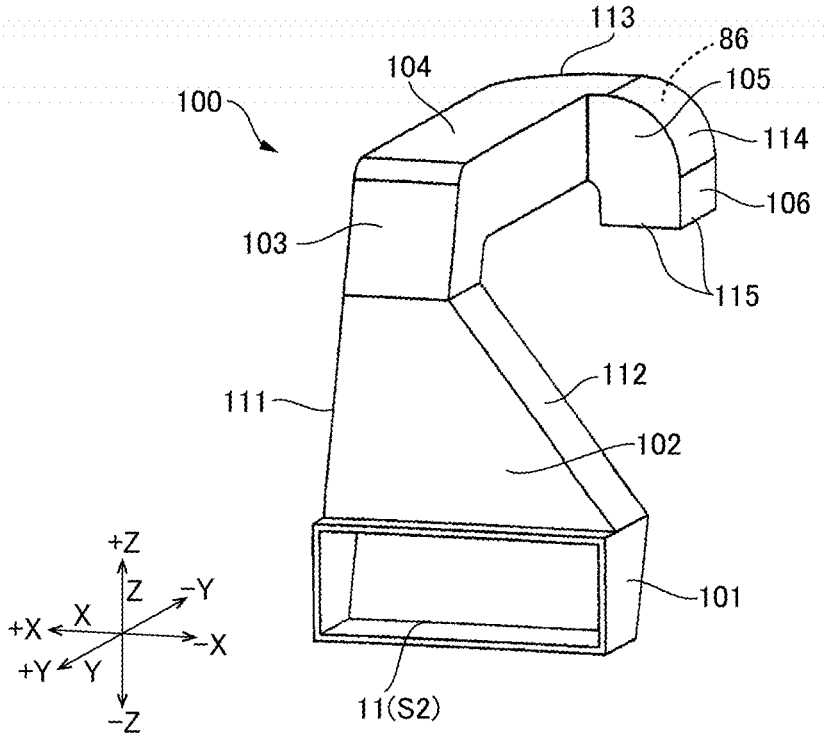
FIG. 13A and FIG. 13B are perspective views showing a cold air duct of an ice making machine in accordance with a second embodiment of the present invention.
Figure 13B:
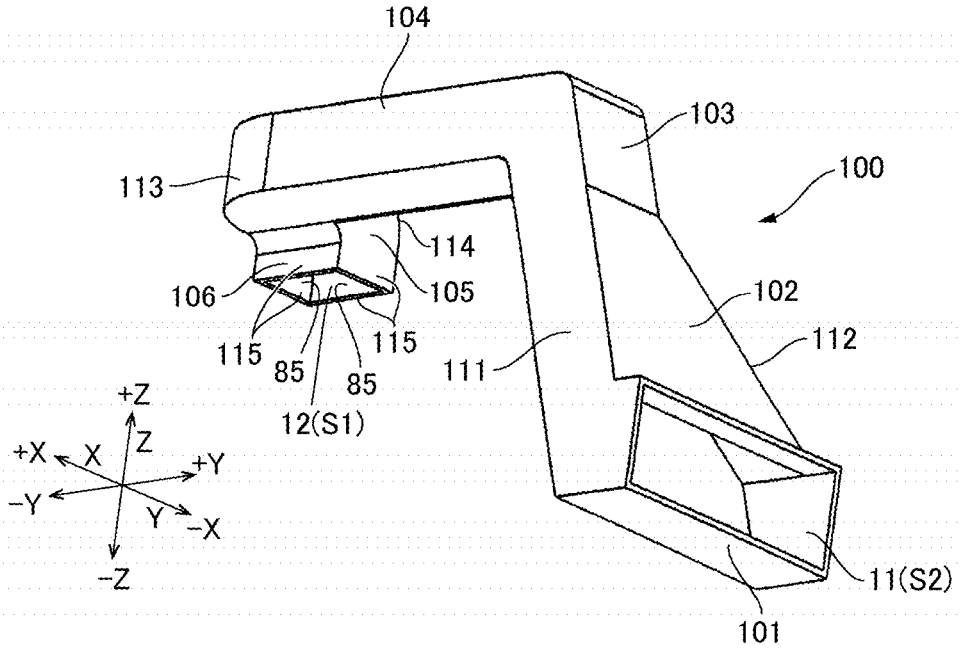

FIG. 11 is a perspective view showing an ice making machine 1A in accordance with a second embodiment of the present invention. FIG. 12A and FIG. 12B are a plan view and a side view showing the ice making machine 1A in FIG. 11. FIG. 13A and FIG. 13B are perspective views showing a cold air duct of an ice making machine 1A in accordance with the second embodiment of the present invention. An ice making machine 1A in this embodiment is provided with a similar structure to the ice making machine 1 in accordance with the first embodiment and thus the same reference signs are used in the corresponding portions and their descriptions are omitted.

As shown in FIG. 11 and FIG. 12A and FIG. 12B, the ice making machine 1A includes a cold air duct 100, an ice tray 20, a drive unit 30 for turning the ice tray 20, and a frame body 40 which supports the ice tray 20 and the drive unit 30. Further, the ice making machine 1A includes an ice storage container not shown which is disposed on a lower side ("−Z"-axis direction side) with respect to the ice tray 20, and an ice detection member 50 structured to detect an amount of ice in the ice storage container. The ice making machine 1A is fixed to a wall face of an ice making chamber "F1" by utilizing attaching parts 60 which are provided in a wall part 44 of the frame body 40. In FIG. 11 and FIG. 12A and FIG. 12B, a headed screw 60*b* for fixing the ice making machine 1A to the wall face of the ice making chamber "F1" is penetrated through a through-hole 60*a* of the attaching part 60. The ice making machine 1A is fixed to the wall face of the ice making chamber "F1" in a state that the wall part 44 of the frame body 40 located on a side in the "−X" direction is abutted with the wall face of the ice making chamber "F1".

A water supply mechanism 55 for supplying water to the ice tray 20 is disposed on an upper side ("+Z" axial direction side) with respect to the ice making machine 1A. The water supply mechanism 55 includes a water supply nozzle 56 for supplying water for ice making to the ice tray 20 from the "+Y" direction side. The water supply nozzle 56 is located on an upper side with respect to the frame body 40.

In this embodiment, a cold air duct 100 is separately structured from the frame body 40. Therefore, in this embodiment, the wall part 43 of the frame body 40 is not provided with the groove part 61 and the intermediate duct portion 70 is not structured in the wall part 43. Therefore, a dimension in the "X"-axis direction of the frame body 40 can be reduced by a width of the groove part 61. In this embodiment, an upper plate part 45 projected to an inner side from an end side portion in the "−Y" direction of the wall part 43 is extended in the "Y"-axis direction along the wall part 43 and is continuously connected with an inner frame part 48 projected to an inner side from the wall part 41. Further, the ice making machine 1A is not provided with the first duct member 57 and the second duct member 58 which are fixed to the frame body 40.

(Cold Air Duct)

A cold air duct 100 is a hollow member. As shown in FIG. 13A and FIG. 13B, the cold air duct 100 is provided with a first duct portion 101 having a cold air inflow port 11 directing from the "+Y" direction toward the "−Y" direction, a second duct portion 102 extended to an upper side from an end in the "−Y" direction of the first duct portion 101, a third duct portion 103 protruded to an upper side from the second duct portion 102, a fourth duct portion 104 extended in the "Y"-axis direction from the third duct portion 103 along the ice tray 20, a fifth duct portion 105 which is bent from the fourth duct portion 104 to the "−X" direction, and a sixth duct portion 106 extended to a lower side from a tip end portion of the fifth duct portion 105.

The first duct portion 101 is formed in a rectangular frame shape whose length in the "X"-axis direction is long and its length in the "Z"-axis direction is short. An opening of an end in the "+Y" direction of the first duct portion 101 is a cold air inflow port 11. In the second duct portion 102, a side plate 111 in the "+X" direction structuring the second duct portion 102 is extended in the "Z"-axis direction and, on the other hand, a side plate 112 in the "−X" direction structuring the second duct portion 102 is inclined to the "+X" direction as going to an upper side. As a result, the second duct portion 102 is inclined to the "+X" direction as a center line of its flow passage is separated from the first duct portion 101 to an upper side. Further, a width in the "X"-axis direction of the second duct portion 102 becomes narrower as separating from the first duct portion 101. The third duct portion 103 is extended with the same width as the width of an upper end of the second duct portion 102. The third duct portion 103 is inclined to the "+X" direction as going to an upper side similarly to the second duct portion 102.

The fourth duct portion 104 is extended with the same width as that of the third duct portion 103 in the "−Y" direction. The fourth duct portion 104 is, as shown in FIG.

12B, extended on an upper side with respect to the frame body 40 so as to have a constant space between the frame body 40 and the fourth duct portion 104. Further, as shown in FIG. 12A, the fourth duct portion 104 is located on the "+X" direction side with respect to the center in the width direction of the ice tray 20. A tip end portion of the fourth duct portion 104 is located at a position facing a center portion of the ice tray 20 from the "+X" direction side. The fifth duct portion 105 is extended to the "−X" direction from the tip end portion of the fourth duct portion 104. A tip end portion of the fifth duct portion 105 faces the center portion of the ice tray 20. The sixth duct portion 106 is extended to a lower side from a lower end of the fifth duct portion 105.

In this embodiment, the fourth duct portion 104 is located on the "+X" direction side with respect to the center in the "X"-axis direction of the ice tray 20 and thus a relatively wide space is provided between the fourth duct portion 104 and the attaching part 60. In other words, the attaching parts 60 are provided in the wall part 44 extended in the "Y" direction, i.e., the longitudinal direction of the ice tray 20, and the fourth duct portion 104 is provided on a near side to the wall part 43 facing the wall part 44 with respect to the center in the "X"-axis direction of the ice tray 20. Therefore, when the ice making machine 1A is to be fixed to the wall face of the ice making chamber "F1", an attaching work is easily performed in which headed screws 60*b* are inserted into the through-holes 60*a* of the attaching parts 60 and the headed screws 60*b* are screwed into threaded holes provided in the wall face of the ice making chamber "F1".

As shown in FIG. 13A and FIG. 13B, in a tip end portion of the fourth duct portion 104 with which the fifth duct portion 105 is connected, the side plate 113 in the "+X" direction structuring the tip end portion is curved toward the "−X" direction as going to the "−Y" direction. Further, in a tip end portion of the fifth duct portion 105 with which the sixth duct portion 106 is connected, the ceiling plate 114 in the "+Z" axial direction structuring the tip end portion is curved to a lower side as going to the "−X" direction. Therefore, flow passage resistance of a portion of the cold air duct 100 where a flow passage is bent is restrained.

The sixth duct portion 106 is formed in a rectangular frame shape. Each of four side plates 115 structuring the sixth duct portion 106 is extended in the "Z"-axis direction. An opening at a lower end of the sixth duct portion is the cold air outlet port 12.

Also in the ice making machine 1A in this embodiment, as shown in FIG. 10, the cold air outlet port 12 of the cold air duct 10 is formed in a rectangular shape and faces a center of an ice making face "C" of the ice tray 20 (a center in the "Y"-axis direction and a center in the "X"-axis direction of the ice making face "C"). The ice making face "C" of the ice tray 20 is a face having a contour including all of a plurality of the ice making recessed parts 21 along edges of openings of the plurality of the ice making recessed parts 21 of the ice tray 20. In this embodiment, the ice making face "C" is rectangular. The ice making face "C" is a face having a contour of a water surface when a predetermined amount of water for ice making is filled in the ice tray 20 located at the ice making position 20A.

Further, an opening area "S1" (N1×N2) of the cold air outlet port 12 of the cold air duct 100 is 4% or more, and not more than 50% of an area "S4" (M1×M2) of the ice making face "C" of the ice tray 20. In addition, in this embodiment, the opening area "S1" of the cold air outlet port 12 is smaller than an opening area "S5" of each of the ice making recessed parts 21.

In this embodiment, the opening area "S1" of the cold air outlet port 12 is not more than 50% of the area "S4" of the ice making face "C" of the ice tray 20 and thus a size of a duct portion of the cold air duct 100 where the cold air outlet port 12 is formed is not required to increase so as to be capable of covering the entire ice tray 20 from an upper side. Therefore, a size of the cold air duct 100 can be reduced. Further, the cold air outlet port 12 faces the center of the ice making face "C" and thus cold air flowed out from the cold air outlet port 12 can be spread over the entire ice tray 20 (ice making face "C"). Therefore, an ice making time for freezing water stored in each of the ice making recessed parts 21 to make ice pieces can be shortened. On the other hand, the opening area "S1" of the cold air outlet port 12 is not less than 4% of the area "S4" of the ice making face "C" of the ice tray 20 and thus, cold air flowed out from the cold air outlet port 12 can be spread over the entire ice tray 20.

A downstream end portion (sixth duct portion 106) of the cold air duct 100 is structured of four side plates 115 extended in the "Z"-axis direction. In this embodiment, the inner side faces of the four side plates 115 extended in the "Z"-axis direction function as a first guide face 85 which is structured to guide cold air flowing out toward the center portion of the ice tray 20 in a direction perpendicular to the ice making face "C" from the cold air outlet port 12 at the downstream end of the cold air duct 100 (see FIG. 13B). Therefore, the cold air flowed through the cold air duct 100 is rectified by the first guide face 85 toward the ice making face "C". Accordingly, an amount of cold air flowed out from the cold air outlet port 12 can be increased and the cold air is blown to the ice tray 20.

In addition, in this embodiment, the inner side face of the ceiling plate 114 of the cold air duct 100 functions as the second guide face 86 structured to guide cold air flowing through the cold air duct 100 to the guide face 85 (see FIG. 13A). More specifically, the inner side face (second guide face 86) of the ceiling plate 114 is curved to a lower side from an upstream side toward a downstream side in a flowing direction of cold air, and the inner side face (second guide face 86) is continuously connected with an upper end edge of the inner side face (first guide face 85) of one of the four side plates 115 structuring the sixth duct portion 106 which is located at the farthest position from the fourth duct portion 104. As a result, the inner side face of the ceiling plate 114 rectifies cold air flowing through the cold air duct 100 toward the inner side face (first guide face 85) of the side plate 115 and thus an amount of the cold air which is flowed out from the cold air outlet port 12 can be increased and the cold air is blown to the ice tray 20.

Further, in this embodiment, the opening area "S1" of the cold air outlet port 12 is smaller than the opening area "S2" of the cold air inflow port 11. Therefore, a flowing speed of the cold air which is flowed out from the cold air outlet port 12 can be increased higher than a flowing speed of the cold air supplied into the cold air supply port "F2". When a flowing speed of the cold air which is blown to the ice tray 20 is increased, water stored in respective ice making recessed parts 21 can be further earlier frozen and thus an ice making time period can be shortened. Further, when a flowing speed of cold air is increased, cold air which is flowed out from the cold air outlet port 12 is easily spread over the entire ice tray 20.

In addition, in this embodiment, the second duct portion 102 of the cold air duct 100 is structured so that the center of the flow passage is inclined to the "+X" direction toward an upper side and its width becomes narrow toward the upper side. Further, the fourth duct portion 104 is located on the "+X" direction side with respect to the center in the "X"-axis direction of the ice tray 20. Therefore, even when a water supply nozzle 56 of the water supply mechanism 55 is provided at the center in the "X"-axis direction of the ice tray 20, the cold air duct 100 and the water supply nozzle 56 of the water supply mechanism 55 can be avoided from interfering with each other.

Further, in the cold air duct 100, a tip end portion of the fourth duct portion 104 with which the fifth duct portion 105 is connected is provided with the side plate 113 which is curved toward the "−X" direction as going to the "−Y" direction. Therefore, flow passage resistance of a portion of the cold air duct 100 where a flow passage is bent is restrained.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making machine which is disposed in an ice making chamber provided with a cold air supply port to which cold air is supplied, the ice making machine comprising:

an ice tray comprising a plurality of ice making recessed parts; and a cold air duct comprising a cold air inflow port connected with the cold air supply port and one cold air outlet port which faces the ice tray on an upper side with respect to the ice tray;

wherein a size of the cold air outlet port is smaller than a size of an ice making face of the ice tray having a contour which includes the plurality of the ice making recessed parts along edges of openings of the plurality of the ice making recessed parts;

wherein the cold air outlet port faces a center portion of the ice making face;

wherein an opening area of the cold air outlet port is 50% or less of an area of the ice making face;

wherein an inner wall face of a downstream end portion of the cold air duct comprises a first guide face structured to guide cold air flowing out from the cold air outlet port toward the ice tray in a direction perpendicular to the ice making face;

wherein the first guide face is extended in an upper and lower direction, wherein the cold air duct comprises a second guide face structured to guide the cold air to the first guide face at a position adjacent to the first guide face on an upstream side in a flowing direction of the cold air, and wherein the second guide face is curved toward the first guide face and is continuously connected with an upper end edge of the first guide face.

2. The ice making machine according to claim 1, wherein the opening area of the cold air outlet port is smaller than an opening area of the cold air inflow port.

3. The ice making machine according to claim 2, wherein the opening area of the cold air outlet port is 4% or more of the area of the ice making face.

4. The ice making machine according to claim 3, wherein the opening area of the cold air outlet port is smaller than an opening area of each of the ice making recessed parts.

5. The ice making machine according to claim 1, wherein the opening area of the cold air outlet port is 4% or more of an area of the ice making face.

6. The ice making machine according to claim 1, wherein the opening area of the cold air outlet port is smaller than an opening area of each of the ice making recessed parts.

7. An ice making machine which is disposed in an ice making chamber provided with a cold air supply port to which cold air is supplied, the ice making machine comprising:

an ice tray comprising a plurality of ice making recessed parts;

a cold air duct comprising a cold air inflow port connected with the cold air supply port and one cold air outlet port which faces the ice tray on an upper side with respect to the ice tray;

a drive unit which is provided at a first end in a longitudinal direction of the ice tray and is structured to turn the ice tray; and a frame body which supports the ice tray and the drive unit;

wherein a size of the cold air outlet port is smaller than a size of an ice making face of the ice tray having a contour which includes the plurality of the ice making recessed parts along edges of openings of the plurality of the ice making recessed parts;

wherein the cold air outlet faces a center portion of the ice making face;

wherein the ice tray is located on an inner side of the frame body, wherein the cold air duct comprises:

an intermediate duct portion provided in a frame body portion of the frame body, the intermediate duct portion extending in the longitudinal direction;

an upstream side duct portion which comprises the cold air inflow port and is communicated with the intermediate duct portion; and a downstream side duct portion which comprises the cold air outlet port and is communicated with the intermediate duct portion, and wherein the downstream side duct portion is extended to an upper side with respect to the frame body from a middle position in the longitudinal direction of the frame body portion.

8. The ice making machine according to claim 7, wherein the intermediate duct portion is extended from a second end in the longitudinal direction of the frame body to the middle position, the upstream side duct portion is communicated with an upstream end of the intermediate duct portion which is opened at the second end, and a bottom face of the intermediate duct portion is inclined to an upper side toward the middle position from the second end.

9. The ice making machine according to claim 7, further comprising a first duct member which is placed on an upper side of the frame body, wherein the frame body comprises a protruded part which is protruded to an inner side at the middle position of the frame body portion, wherein the protruded part comprises a recessed part on its upper face, wherein the frame body portion comprises a groove part on its upper face which is extended from a second end in the longitudinal direction of the frame body to the middle position, and an opening part structured to communicate the groove part with the recessed part at the middle position, wherein the first duct member comprises:

a duct forming part which is placed on a portion at the middle position of the frame body portion and the protruded part from an upper side and covers a first end in the longitudinal direction of the groove part and the recessed part; and a cover plate part which is extended to a second end in the longitudinal direction of the groove part from the duct forming part and covers a portion of the groove part which is not covered by the duct forming part from an upper side, wherein the intermediate duct portion is structured of an inner wall face of the groove part, an inner wall face of the recessed part, and an under face of the cover plate part of the first duct member, and wherein the downstream side duct portion is structured between the duct forming part and the frame body.

10. The ice making machine according to claim 9, wherein an opposed face of the protruded part facing the ice tray is a concave curved face, and the opposed face is curved to an upper side as going to a center of the ice tray in a short-side direction of the ice tray.

11. The ice making machine according to claim 7, further comprising a second duct member which comprises the upstream side duct portion and is attached to the frame body.

12. The ice making machine according to claim 7, wherein an opening area of the cold air outlet port is 50% or less of an area of the ice making face.

13. The ice making machine according to claim 12, wherein an inner wall face of a downstream end portion of the downstream side duct portion of the cold air duct comprises a first guide face structured to guide the cold air which is flowed out from the cold air outlet port toward the ice tray in a direction perpendicular to the ice making face.

14. The ice making machine according to claim 13, wherein the first guide face is extended in an upper and lower direction, the downstream side duct portion comprises a second guide face structured to guide the cold air to the first guide face at a position adjacent to the first guide face on an upstream side of the first guide face in a flowing direction of the cold air, and the second guide face is curved toward the first guide face and is continuously connected with an upper end edge of the first guide face.

15. The ice making machine according to claim 14, wherein the opening area of the cold air outlet port is smaller than an opening area of the cold air inflow port.

16. The ice making machine according to claim 15, wherein the opening area of the cold air outlet port is 4% or more of the area of the ice making face.

17. The ice making machine according to claim 16, wherein the opening area of the cold air outlet port is smaller than an opening area of each of the ice making recessed parts.

* * * * *